US009066551B2

(12) United States Patent
Van Waes

(10) Patent No.: US 9,066,551 B2
(45) Date of Patent: Jun. 30, 2015

(54) SELF-ADJUSTING RETENTION SYSTEM FOR A HELMET

(75) Inventor: Sean Van Waes, Antwerp (BE)

(73) Assignee: Lazer Sport NV, Antwerp (BE)

( * ) Notice: Subject to any disclaimer, the term of this patent is extended or adjusted under 35 U.S.C. 154(b) by 32 days.

(21) Appl. No.: 13/806,431

(22) PCT Filed: Jun. 28, 2011

(86) PCT No.: PCT/EP2011/060784

§ 371 (c)(1),
(2), (4) Date: Aug. 6, 2013

(87) PCT Pub. No.: WO2012/000973

PCT Pub. Date: Jan. 5, 2012

(65) Prior Publication Data

US 2013/0312163 A1 Nov. 28, 2013

(30) Foreign Application Priority Data

Jun. 28, 2010 (EP) ..... 10167497

(51) Int. Cl.

| | |
|---|---|
| ***A42B 7/00*** | (2006.01) |
| ***A42B 3/08*** | (2006.01) |
| ***A42B 3/14*** | (2006.01) |

(52) U.S. Cl.

CPC .. *A42B 3/08* (2013.01); *A42B 3/145* (2013.01)

(58) Field of Classification Search

CPC ..... A42B 3/08

USPC ..... 2/410, 416, 417, 418, 419, 420, 421, 2/8.1

See application file for complete search history.

(56) References Cited

U.S. PATENT DOCUMENTS

| | | | | |
|---|---|---|---|---|
| 3,092,837 | A * | 6/1963 | Austin | 2/419 |
| 5,042,093 | A | 8/1991 | Legendre | |
| 5,572,749 | A * | 11/1996 | Ogden | 2/421 |
| 5,983,405 | A | 11/1999 | Casale | |
| 6,401,261 | B1 * | 6/2002 | Arney et al. | 2/421 |
| 6,425,142 | B2 | 7/2002 | Sasaki et al. | |
| 6,865,752 | B2 * | 3/2005 | Udelhofen et al. | 2/425 |
| 7,174,575 | B1 * | 2/2007 | Scherer | 2/418 |
| 7,222,374 | B2 * | 5/2007 | Musal et al. | 2/421 |
| 8,015,625 | B2 * | 9/2011 | Grim et al. | 2/420 |
| 2006/0195974 | A1 | 9/2006 | Burkhart et al. | |

FOREIGN PATENT DOCUMENTS

| | | |
|---|---|---|
| DE | 295 16 286 U1 | 10/1995 |
| FR | 2 838 611 | 10/2003 |

* cited by examiner

*Primary Examiner* — Tejash Patel
(74) *Attorney, Agent, or Firm* — Levy & Grandinetti

(57) ABSTRACT

The present invention is directed to a self-adjusting retention system for a helmet including a front head belt, a rear basket and a tensioning means or device for tensioning the front head belt and the rear basket along a wearer's head. The tensioning means includes a spring and a cable attached to the front head belt. The spring tensions the front head belt via the cable. In addition, the present invention is directed to a helmet including a dome and a self-adjusting retention system attached to the dome.

8 Claims, 2 Drawing Sheets

SELF-ADJUSTING RETENTION SYSTEM FOR A HELMET

This Application is the U.S. National Phase of International Application No. PCT/EP2011/060784 filed on Jun. 28, 2010, which claims priority to European Application No. 10167497.6 filed on Jun. 28, 2010.

FIELD OF THE INVENTION

The present invention relates to a self-adjusting retention system for a helmet. In addition, the invention relates to a helmet comprising such self-adjusting retention system.

BACKGROUND OF THE INVENTION

The main goal of wearing a helmet is to avoid getting injured. The retention system of a helmet is therefore very important and has a main influence, besides on comfort, also on safety.

Therefore many helmet manufacturers developed systems for providing advanced retention systems to optimize both safety and comfort.

Most of these retention systems include an adjustment mechanism, which permits a wearer to tighten or loosen the retention system, while the helmet is on the wearer's head. Such adjustment mechanism comprises usually a knob or another shape providing grip for the wearer to adjust the tension on his head, connected to a ratchet or a screw, e.g. Lazer Sport's Rollsys system.

A general disadvantage of the above retention systems is that the adjustment mechanism requires action from the wearer to tighten or loosen the retention system to the appropriate size.

U.S. Pat. No. 6,425,142 addresses the above problem and suggests a retention system which comprises besides a adjustment mechanism for adjusting the size, an elastic element or a spring for positioning the dome against the occipital region of the wearer's head to stabilize the helmet against the wearer's head.

However, still action from the wearer is required. Moreover, the spring pushes the adjustment mechanisms against the occipital region of the wearer's head which may result in asymmetrical tightening and unequal pressure distribution along the head.

Further disadvantages are that such adjustment mechanism combined with an elastic element or a spring is clearly visible and esthetically not attractive, and that elastic elements lose their natural qualities over time.

Considering the above, it is a first object of the present invention to provide a retention system for a helmet which only requires limited action or even no action from the wearer to tighten or loosen it to the appropriate size.

It is another object of the present invention to provide a retention system for a helmet providing improved symmetrical tightening and improved pressure distribution along the wearer's head, resulting in improved overall comfort.

Further it is an object of the present invention to provide a retention system for a helmet, which may be less visible and/or may be more esthetically attractive.

The present inventions meets the above objects by proposing a retention system having a tensioning means comprising a spring and wherein both the front head belt and the rear basket are tensioned via a cable by said spring.

SUMMARY OF THE INVENTION

The present invention is directed to a self-adjusting retention system for a helmet comprising a front head belt, a rear basket and a tensioning means for tensioning the front head belt and the rear basket along a wearer's head, characterized in that the tensioning means comprises a spring and a cable attached to the front head belt, said spring tensioning the front head belt via said cable.

In addition, the present invention is directed to a helmet comprising a dome and such self-adjusting retention attached to the dome.

DESCRIPTION OF THE INVENTION

Figure 1:
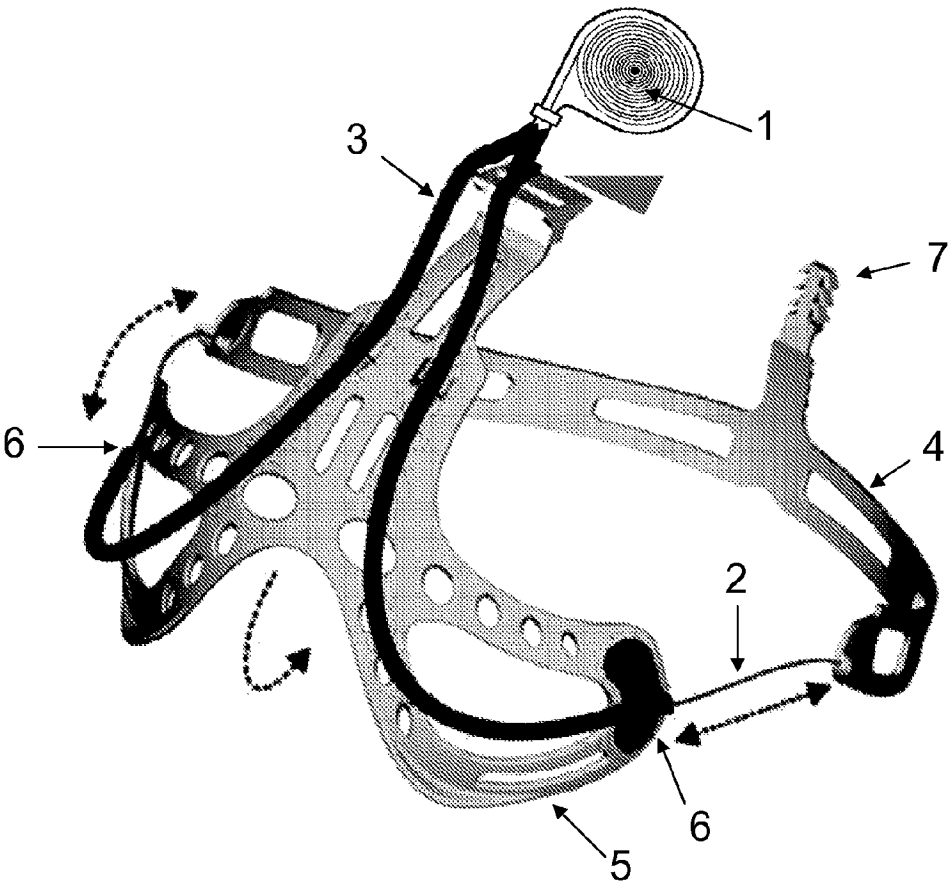
FIG. 1 illustrates an embodiment of a self-adjusting retention system in accordance with the present invention.
Figure 2:
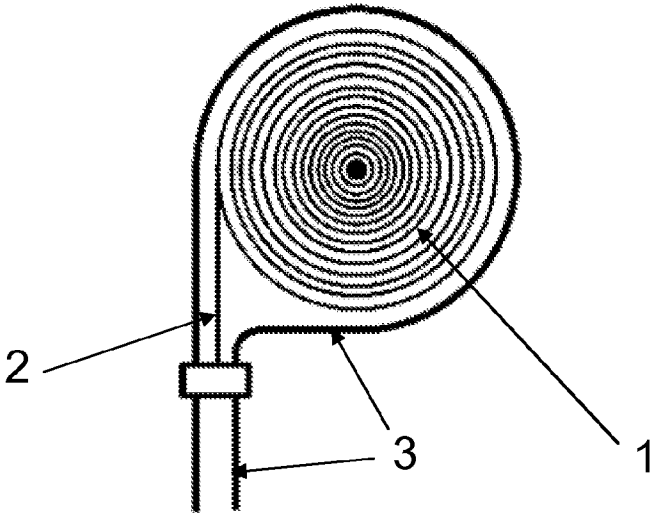
FIG. 2 illustrates a spring and cable in a casing as may be used in a self-adjusting retention system in accordance with the present invention.

In the context of the present invention, a helmet is understood as all types of helmets making use of a retention system, such as sports helmets, safety helmets, military helmets, etc.

According to a first embodiment of the present invention, a self-adjusting retention system for a helmet is provided comprising a front head belt (4), a rear basket (5) and a tensioning means for tensioning the front head belt and the rear basket along a wearer's head, characterized in that the tensioning means comprises a spring (1) and a cable (2) attached to the front head belt, said spring tensioning the front head belt via said cable.

By tensioning the front head belt by a spring via a cable attached to the front head belt and the spring, the retention system only requires limited action or even no action from the wearer to tighten or loosen it to the appropriate size. Upon pushing the front head belt away from the spring (and from the rear basket) in order to put the helmet on the head, the retracting force of the spring causes a tension in the cable and in the front head belt. The spring will try to retract and will automatically adapt the retention system to the wearer's head size.

Another advantage is that the pressure along the wearer's head is spread over substantially the complete perimeter of the head because the It is another object of the present invention to provide a retention system for a helmet providing improved symmetrical tightening and improved, constant pressure distribution along the wearer's head, resulting in improved overall comfort.

In an embodiment in accordance with the present invention, the cable may be movably connected to the rear basket. By doing so, both the rear basket and the cable which is attached to the front head belt and the spring may be held easier at the appropriate position, additionally resulting in better pressure distribution along the wearer's head. The cable may be connected to the rear basket by any kind of holding means (6) allowing a movement of the cable independently from the rear basket.

In a particular embodiment in accordance with the present invention, the spring may be a coil spring, preferably a constant force coil spring. Such constant force coil spring is a coil spring for which the force it exerts over its range of motion is a constant. Generally constant force springs are constructed as a rolled ribbon of spring steel such that the spring is relaxed when it is fully rolled up. As it is unrolled, the restoring force comes primarily from the portion of the ribbon near the roll. Because the geometry of that region remains nearly constant as the spring unrolls, the resulting force is nearly constant. So, the advantage of using such constant force coil spring in the retention system of the present invention may be that the pressure along the wearer's head may be independent on his head size.

In an embodiment according to the present invention, the cable may be made of elastic material.

In addition, the present invention provides a helmet comprising a dome and a self-adjusting retention system as described above and attached to the dome. The front head belt and the rear basket may be attached to the dome. The spring may be fixed to the rear basket or preferably fixed to the dome.

In the latter case the spring may be located in a casing (3) fitted in the dome, which makes the retention system less visible and the helmet more esthetically attractive. The casing may be an injected plastic part particularly designed for housing the spring.

In embodiment in accordance with the present invention, the front head belt and the rear basket may be removably connected to the dome by hangers (7). As such, the retention system may be easily removed from the dome for cleaning or storing purposes.

The invention claimed is:

1. A self-adjusting retention system for a helmet comprising a front head belt, a rear basket and a tensioning means for tensioning the front head belt and the rear basket along a wearer's head, characterized in that the tensioning means comprises a spring and a cable attached to the front head belt, said spring tensioning the front head belt via said cable and said cable being movably connected to the rear basket.

2. A self-adjusting retention system for a helmet according to claim 1, wherein the spring is a coil spring.

3. A self-adjusting retention system for a helmet according to claim 2, wherein the spring is a coil spring and is a constant force coil spring.

4. A self-adjusting retention system for a helmet according to claim 3, wherein the cable is made of elastic material.

5. A helmet comprising a dome and a self-adjusting retention system according to claim 4, attached to the dome.

6. A helmet according to claim 5, wherein the spring is fixed to the dome.

7. A helmet according to claim 6, wherein the spring is located in a casing fitted in the dome.

8. A helmet according to claim 5, wherein the front head belt and the rear basket are removably connected to the dome by hangers.

* * * * *